US008875846B2

(12) United States Patent
Imfeld et al.

(10) Patent No.: US 8,875,846 B2
(45) Date of Patent: Nov. 4, 2014

(54) SPEED LIMITER IN AN ELEVATOR SYSTEM

(75) Inventors: Marcel Imfeld, Kerns (CH); Karsten Gensicke, Buchrain (CH)

(73) Assignee: Inventio AG, Hergiswil (CH)

( * ) Notice: Subject to any disclaimer, the term of this patent is extended or adjusted under 35 U.S.C. 154(b) by 356 days.

(21) Appl. No.: 13/321,014

(22) PCT Filed: Jun. 1, 2010

(86) PCT No.: PCT/EP2010/057573

§ 371 (c)(1),
(2), (4) Date: Nov. 17, 2011

(87) PCT Pub. No.: WO2010/139667

PCT Pub. Date: Dec. 9, 2010

(65) Prior Publication Data

US 2012/0061189 A1 Mar. 15, 2012

(30) Foreign Application Priority Data

Jun. 4, 2009 (EP) ..... 09161962

(51) Int. Cl.
*B66B 5/04* (2006.01)

(52) U.S. Cl.
CPC ..... *B66B 5/044* (2013.01); *B66B 5/046* (2013.01); *B66B 5/048* (2013.01)
USPC ..... 187/373; 187/305

(58) Field of Classification Search
CPC ..... B66B 5/04; B66B 5/044; B66B 5/046
USPC ..... 187/276, 286, 287, 305, 350, 373, 374, 187/376
See application file for complete search history.

(56) References Cited

U.S. PATENT DOCUMENTS

| | | | | |
|---|---|---|---|---|
| 1,873,809 | A * | 8/1932 | Baldwin | 187/287 |
| 3,187,128 | A * | 6/1965 | Hammer | 200/61.45 R |
| 5,513,723 | A * | 5/1996 | Luebke | 187/244 |
| 6,619,435 | B1 * | 9/2003 | Watzke et al. | 187/373 |
| 7,134,529 | B2 * | 11/2006 | Maury | 187/359 |
| 7,669,697 | B2 * | 3/2010 | Ueda et al. | 187/391 |
| 7,753,176 | B2 * | 7/2010 | Kigawa et al. | 187/286 |
| 2003/0183457 | A1 * | 10/2003 | Maury et al. | 187/250 |
| 2011/0272223 | A1 * | 11/2011 | Drayer et al. | 188/65.1 |
| 2013/0105250 | A1 * | 5/2013 | Meierhans et al. | 187/350 |

FOREIGN PATENT DOCUMENTS

| | | | |
|---|---|---|---|
| DE | 7207296 | U | 10/1972 |
| DE | 3615270 | A1 | 3/1987 |
| JP | 48093056 | A | 12/1973 |

* cited by examiner

*Primary Examiner* — William E Dondero
*Assistant Examiner* — Minh Truong
(74) *Attorney, Agent, or Firm* — Fraser Clemens Martin & Miller LLC

(57) ABSTRACT

A speed limiter for an elevator system includes: at least one speed limiter wheel having a first radial cam with lobes, and at least a second, phase-shifted radial cam with lobes; a first mass, which is rotatably arranged in a first pivot bearing and which together with a first roller rolls on the first radial cam such that the first mass follows a first oscillating motion when the speed limiter wheel rotates; and a second mass, which is rotatably arranged in a second pivot bearing and which together with a second roller rolls on the second radial cam such that the second mass follows a second oscillating motion when the speed limiter wheel rotates.

16 Claims, 10 Drawing Sheets

Stand der Technik
State of the Art
État de la technique

2 Car
4 Counterweight
6 Drive Unit
8, 9, 10, 11 Floor
25 Weight
29 Switch
31 Control
38a, 38b Safety Brake Device
63 Control Device

SPEED LIMITER IN AN ELEVATOR SYSTEM

FIELD

The present invention relates to an elevator installation in which at least one mechanical safety system is provided, which comprises a safety brake device, an actuating mechanism, a speed limiter and a tensioning device, all connected by a limiter cable. The present invention relates particularly to the speed limiter and to a method of operating a speed limiter.

BACKGROUND

Speed limiters according to the current state of the art usually comprise a speed limiter wheel which is formed with lobes or cams and which can be designed as a separate disc cam or cam disc. This cam disc can also be integrally integrated in a cable pulley which is moved by the limiter cable running together with the elevator car. DE 3615270 shows a speed limiter of that kind. Moreover, there are also constructions in which the cam disc is designed as a guide wheel running together with the car. However, it is common to all of these design variants of speed limiters that when the cam disc rotates the lobes of the cam disc provide at the circumference thereof a wave-shaped or sinusoidally curved sequence of lobes and valleys, which sequence is termed cam track or, in the following, control cam.

The lobes or the control cam acts or act, depending on the rotational speed of the cam disc, counter to the inertia and/or the force of a return spring on a mass which runs by a roller on the cam track or control cam. This mass is usually designed as pawl or as a rotatably mounted pendulum with a pendulum nose which describes a movement on attainment of a specific rotational speed of the cam disc or when the moment of inertia of the pendulum, which is thus set in oscillation, exceeds the restoring moment of the restoring spring.

This movement of the pendulum nose is used, for example, in order to trigger or actuate a pre-contact switch with the help of which the further drive of the elevator car or the counterweight is switched off in advance. The principal system-intrinsic parameters of this principle of triggering, namely the number, arrangement and height of the lobes on the cam disc, the mass inertia of the pendulum and the restraining force of the restoring spring, thus allow, as a first safety step, switching-off of the drive at a specific rotational speed of the cam disc. This specific rotational speed of the cam disc is thus termed pre-contact speed (VCK).

If the rotational speed of the cam disc rises further or the pre-contact speed is exceeded and a trigger speed (VCA) is reached, then the pendulum nose of the same pendulum or also of a second pendulum detents in recesses or blocking cams or detent lugs, which are provided therefor, and thereby blocks the cable pulley of the limiter cable. This blocking of the cable pulley of the limiter cable in turn has the consequence that a friction force builds up between the cable pulley and the limiter cable and in turn triggers, as a second safety step, the safety brake device of the elevator car.

The triggering of the safety brake device ultimately takes place through a tension force (FC) which arises in the limiter cable due to the friction between the limiter cable and the cable pulley. This tension force is used, in the case of a single-acting speed limiter system, by means of a trigger mechanism only for triggering of the safety brake device in the event of downward movements of the elevator car. In the case of a double-acting speed limiter system triggering takes place not only for downward movements, but also for upward movements of the elevator car. The trigger mechanism usually comprises a further safety switch which is similarly in a position of interrupting the safety circuit of the elevator control.

A general disadvantage of this principle of construction of a conventional speed limiter system is that only a single specific trigger value, which corresponds with the fixed parameters of the components, can be set at the works. Consequently, it is disadvantageous, for example, that—if, for example, consideration is given only to the mechanical triggering of the safety brake device in itself alone—the elevator installation is usually operated during assembly over a longer test period of time at a reduced speed and in this case the speed limiter system responds only in the case of significantly higher speeds. This can mean that in the event of a risk situation during this test period of time in the assembly phase the safety brake device is triggered only very late or even that the elevator car travels, without braking, onto the shaft buffer at a speed which still lies below the trigger value corresponding with normal operation.

Moreover, it is disadvantageous with conventional speed limiter systems that, particularly in the case of elevator installations conceived and permissible for higher rated speeds such as, for example, VKN=1.5 m/s, the biasing of the restraining spring has to have substantial values. This in turn has the consequence that the pendulum exerts large spring forces or reaction forces on the cam disc and on the cable pulley fixedly connected therewith. Depending on the respective setting of the roller of the pendulum on the control cam, i.e. depending on whether the roller just describes the rising path towards the crest point of an individual lobe or just describes the path falling away from the crest point of the lobe, the high restraining forces manifest themselves as a deceleration or acceleration of the rotational speed of the cam disc. These inconstancies or periodic deviations of the rotational speed of the cam disc from a constant rotational speed are transmitted to the cable pulley, from this to the limiter cable and from this to the elevator car. This leads to deteriorated travel comfort, undesired vibrations, excessive material stressing and output of noise.

By way of example, measurements have shown that the cause of car vibrations is attributable to the speed limiter or the number, arrangement and design of the lobes of the cam disc and the rotational speed of the cam disc. Thus, for example, specific embodiments of elevator installations of the applicant manufacturer have a car vibration maximum value of 19 Hertz. In the case of an exemplifying cable pulley diameter D of 0.2 m or a cable pulley circumference U of $D \cdot \pi = 0.628$ m and an exemplifying elevator car rated speed VKN of 1.5 m/s an angular speed $\omega = VKN/U = 1.5/0.628 = 2.388\ s^{-1}$ results therefrom. In the case of, for example, eight lobes on the cam disc this gives a frequency $f = 2.388 \cdot 8 = 19.1$ Hertz. The frequency f of the cable pulley is thus provably the excitation frequency for the measured car vibrations.

A further disadvantage of known speed limiters is that they only insufficiently satisfy the demands of elevator installations without engine rooms such as are currently ever more frequently desired. Thus, the omission of the engine room has, for example, the effect that an unrestricted capability of access to the speed limiter itself is no longer ensured and thus new possibilities or new interfaces at the speed limiter for installation, for setting—whether at the time of initial installation or at the time of later normal operation or at the time of maintenance work—and for triggering in cases of risk and for resetting after triggering has taken place have to be provided.

SUMMARY

An object of the present invention is to optimize a speed limiter of known mode of construction.

One constructional variant of the speed limiter consists initially in the arrangement of two separate masses which act independently of one another, for example in the form of pendulums as previously described, which have different moments of inertia and/or are pulled or pressed by different biasing forces against a cam disc with a control cam common for the two pendulums. As a result, there is realized a first basic variant of embodiment in which trigger values, which are distinctly separable from one another and thus also separately settable, of a pre-contact speed and a trigger speed can be evidenced.

At a specific rotational speed of the cam disc the periodic sequence of the mass pulses or the rapidity of this periodic sequence thus overcomes the inertia of the first pendulum with a smaller moment of inertia or with a weaker restraining spring before the same can occur at the second pendulum which has greater inertia or is restrained or urged by a stronger restraining spring. A later occurring reduction in the periodicity of the periodic sequence of lobes due to an increasing rotational speed of the cam disc will also no longer be able to be followed by the roller of the second pendulum, i.e. the roller will no longer be able to describe the lobes and depressions and thus lift up this second pendulum so that it is triggered.

In this manner, two different, definedly separate trigger values are realized, i.e. a first with the first weakly restrained or pressed and/or lighter pendulum for the advance switching-off of the drive and a second with the more strongly restrained or pressed and/or heavier pendulum for the mechanical actuation of the safety brake device. Depending on the respective influence of the pendulum or the bias of the restraining spring pulling it or compression spring pressing it the trigger values can be widened or approximated as desired.

To the advantage of preferably rapid reaction times on the occurrence of a risk situation the triggering actions, which are advantageously defined to be independent of one another, can also be provided without an expansion. This can be realized—without representing a loss in safety—in that there is no longer a first excess speed for the triggering of the pre-contact switch for turning-off the drive and only a second, higher excess speed for mechanical triggering of the safety brake device, but a single excess speed value simultaneously causes both triggering actions.

The described variant of embodiment of a speed limiter can optionally be designed with a cam disc which is formed integrally with the cable pulley, but also form a cam disc separate from the cable pulley and fixedly connected therewith. The cam disc in turn can have a common control cam for the two pendulums or, however, also a respective control cam per pendulum on a common cam disc or on a respective cam disc.

The different pendulums can be arranged independently from one another on a respective axle, but preferably both are mounted on a common axle.

A similar, mechanically defined separation of the two trigger values is realized in a further design variant of a speed limiter in that two different or, however, also two identical pendulums are associated with a cam disc with two different control cams—or with two cam discs each with a respective one of mutually different control cams—which differ, for example, in their diameters.

In the case of an identical or individual rotational speed of the control cams the smaller control cam, i.e. that with the smaller circumference, will thus have a smaller periodicity in the sequence of lobes. In this manner two mutually independent and separate trigger values can be defined by preferably identical pendulums and identical restraining springs. With this variant of embodiment it is advantageous that identical components can be produced more economically and do not conceal a risk of confusion in assembly.

Definedly different trigger values for the advance switching off and mechanical actuation of the safety brake device can also be achieved in that—with preferably identical pendulums and identical restraining springs—the lobes of the first control cam are higher than the lobes of the second control cam. The higher lobes of the first control cam give an earlier trigger value for a specific rotational speed of the cable pulley and the lower lobes of the second control cam give a later trigger value for a higher rotational speed of the cable pulley.

A variant of embodiment of a speed limiter provides two identical or also different pendulums, to each of which a respective individual control cam is allocated. These control cams, whether with identical or different diameters, are displaced in phase, i.e. the lobes are offset on the circumference of one cam disc or on the circumferences of two cam discs. In other words, if the crest point of a first lobe of the first control cam is, for example, at zero degrees then the crest point of a first lobe on the second control cam is displaced by a few degrees. This displacement in phase is preferably selected so that the drive frequency of the first control cam is superimposed on an oppositely poled superimposition frequency of the second control cam so that the vibrations at least substantially—preferably at least at the maximum values thereof—are mutually cancelling. The speed limiter is improved, since vibrations or noises in the elevator installation are reduced as a consequence of the phase displacement. In addition, due to the smooth running of the speed limiter a speed can be measured more reliably. Thus, for example, the advance switching-off speed can be measured more reliably.

Calculations and tests have shown that a phase displacement or an angle between the crest point of a first lobe of the first control cam and the crest point of a first lobe of the second control cam in correspondence with a half angle distance of two mutually successive lobes of the first control cam is preferred. Thus, a phase displacement or an angle of 15 to 30 degrees usually results. In the case of use of a control cam with eight lobes a preferred displacement or an angle of 22.5 degrees between the crest point of a first lobe of the first control cam and the crest point of the first lobe of the second control cam thus results. For example, with the last-mentioned parameters a superimposition sine curve, which by comparison with a total sine curve of two control cams of same phase has a halved periodicity (doubled frequency) and an amplitude reduced to a quarter, results. The frequency, which is thus doubled to approximately 38 Hertz, of an exemplifying speed limiter is no longer perceived as disruptive, because the limits therefor lie at approximately 30 Hertz or because the system-intrinsic relevant components of the elevator installation less satisfactorily accept and pass on the increased frequency. A further advantage is the amplitude, which is reduced by three-quarters and which leads to greater running quietness in the elevator car. These overall yield a reduced output of noise, improved comfort and a less problematic capability of use of a speed limiter, which is designed in that manner, for elevator installations with higher travel speeds.

The phase displacement is thus preferably simply half the spacing between the crest points of two adjacent lobes. The pendulums preferably describe as an end result an asynchronous pendulating movement which is in opposite sense, but which that apart is preferably symmetrically asynchronous to the extent that the first pendulum reaches its highest point (greatest spacing from the axis of the cable pulley or the speed limiter wheel) when the second pendulum is just disposed at its lowest point.

As already mentioned, this variant of embodiment of the speed limiter comprises two separate masses acting independently of one another, for example in the form of pendulums. One pendulum is provided for advance switching-off of the drive and the other for mechanical triggering of the safety brake device. That pendulum which is provided for the advance switching-off of the drive usually actuates an electrical pre-contact switch (KBV). This pre-contact switch is preferably executed as a circuit breaker and preferably comprises an integrated stroke magnet by which the pendulum is electrically resettable after triggering has taken place (ERR function). That pendulum which in turn is provided for the mechanical triggering of the safety brake device comprises a further stroke magnet by means of which the pendulum can be electrically remotely triggered as a simulation for an actual risk situation (ERC function). This function is customarily required only in the case an acceptance test when placing the elevator installation in operation.

Through this arrangement of two separate stroke magnets, one for remote triggering and one for remote resetting, it is ensured, even with elevator installations without an engine room, that it is possible to trigger and reset the speed limiter from outside the elevator shaft.

So that an optimum protection is present even in the assembly phase in which the elevator installation is operated at reduced speed a speed limiter is so designed in accordance with a variant of embodiment that the stroke magnet for the remote triggering is also activatable during this assembly phase. In other words, provision is made to assign to an electrical/electronic speed detection, which controls the stroke magnets for the remote triggering, at least two different programmable trigger values of which one trigger value is provided for normal operation and the other trigger value, which triggers earlier, for a reduced car rated speed, for example for the assembly phase. A speed limiter with low-vibration running is particularly suitable for that purpose and requirements for use of a speed limiter with elevator installations without an engine room can be fulfilled, since this speed limiter can at the same time be remotely actuated. This saves costs and increases the quality of the elevator installation.

The electrical/electronic speed monitoring is preferably designed so that a pole ring is arranged on the cable pulley of the speed limiter and at least one corresponding sensor is fastened to an end panel of the speed limiter or to a housing of the speed limiter. This sensor can be, for example, a magnetized pole ring, the rotation of which or—stated more precisely—the rotational speed of which is contactlessly detected by, for example, an inductive sensor. In addition, two sensors or two pole rings can optionally be used with one or two sensors.

However, by means of an apertured disc it is also possible to optically detect, for example by a light beam which is directed directly or by a mirror onto a sensor, the rotational speed of the apertured disc on the basis of interruptions of the light beam, preferably similarly contactlessly as in the case of the design variants with magnetized pole ring and inductive sensor.

In an example, the actual assembly travel speed (VKN_M) of the respective elevator installation is learnt in the course of the assembly process, preferably as soon as the elevator installation or the travel bodies thereof are in movable state, by software of the electrical/electronic speed detection by way of a learning travel from below to above (or conversely) and is multiplied by a factor, for example by a factor 1.1, for a value higher by 10%. In this variant of embodiment, on reaching the new, learnt assembly phase trigger value the stroke magnet which normally triggers the safety brake device only in the case of an acceptance test is activated. In the case of normal operation in turn, the electrical/electronic speed detection is restricted by means of the normal operation trigger value to advance switching-off of the drive.

The trigger value of a reduced car rated speed or the assembly travel speed can thereby be adapted and thus a significantly increased level of safety for the engineer or for service personnel can be achieved. The new, learnt trigger value is preferably stored on an EPROM (Erasable Programmable Read-Only Memory) of the control of the speed limiter.

So as not to lose the safety function of the advance switching-off of the drive even in the assembly phase, the new, learnt trigger value can optionally be used not only as described for triggering of the safety brake device, but also for an advance switching-off of the drive upstream of the normal operation. These two upstream assembly travel triggering actions can thus be simultaneously triggered, but the software of the electrical/electronic speed detection can also initially learn the required assembly travel trigger value for the safety brake device and subsequently an assembly trigger value, which is, for example, reduced by 6%, for the advance switching-off can be simply—quasi artificially—stored.

According to a preferred variant of embodiment of a speed limiter the described speed limiter control is in a position of communicating bidirectionally with the lift control. In this manner the following risk situations can thus be covered:

- excess speed during the assembly phase (VKN_M+10%)
- excess speed during normal operation by switching or interruption of the pre-contact switch (KBV) and thereby interruption of the safety circuit of the elevator installation, for example at elevator car rated speed (VKN) plus 10%
- uncontrolled movement of the elevator car with opened door in that a comparison of the signals of the speed limiter control with the status of the safety circuit of the elevator installation takes place
- insufficient retardation of an elevator acceleration with open safety circuit, for example in the case of slipping of the single or multiple support means on the drive pulley or drive pulleys.

Moreover, the inductive or optical sensor system is preferably used as simplified shaft copying. It is thereby further ensured that even elevator installations without a separate copying can be evacuated independently of travel in that on reaching a door contact directly at a shaft door the elevator movement is terminated. It is thereby possible to directly free trapped passengers at any desired floor. This travel-dependent evacuation possibility can also be used in 'normal' emergency stops and is independent of the risk situations listed above.

A significant advantage of a proposed speed limiter with an electrical/electronically defined trigger value ahead of the normal trigger value is that the usual use of separate clip-shaped mounting plates, which can be arranged subsequently, with a mechanical spring for correction of the restraining force of the restraining spring can be eliminated. The correction of a spring by another spring obviously does not offer a clearly defined trigger value and moreover there is a risk of confusion of the mechanical springs, which are usually prefabricated and which are of different strengths according to the respective elevator car rated speeds intended for normal use.

A further advantage is the usability of a proposed speed limiter in elevator installations without an engine room. Access to the speed limiter in order to ensure mounting and removal of the mechanical correction springs no longer has to be provided. In addition, installation time is reduced.

A further advantage is the possible capability of use of a proposed speed limiter not only in singly-acting, but also in doubly-acting, i.e. upwardly and downwardly, speed limiter systems. This takes place at least in one variant of embodiment, which in downward direction ensures an electrical upstream assembly-travel triggering of the pre-contact switch, an electrical upstream assembly-travel triggering of the safety brake device, an electrical normal-operation triggering of the pre-contact switch and a mechanical normal-operation triggering of the safety brake device. In upward direction, thereagainst, similarly at least the just-described three electrical forms of triggering, but no mechanical normal-operation triggering of the safety brake device.

Moreover, it is advantageous that the proposed electrical/electronic generation of an upstream trigger value for the assembly phase can be produced as a system-specific independent set which can be used with different speed limiter systems or even combined with outside components.

Depending on the respective requirements with respect to the accuracy of the speed resolution or with respect to the requisite fineness of the signals a standardized pole ring with several increments can be used and also preferably combined with two different sensor types. One sensor type is economically advantageous and conceived only for general applications, whilst the other sensor type is conceived for, for example, higher speed resolutions.

The combinatorial system of pole ring and sensor can be set, checked and secured at the manufacturing works, but can also be adapted, adjusted and memorized at the construction site by means of a learning travel during the assembly process and during normal operation.

Also within the scope of the present invention is a design variant of a speed limiter with two control cams—be it with two identical control cams, two different control cams, two phase-displaced control cams or two different and phase-displaced control cams—and three pendulums. These three pendulums define three different trigger values, for example a first pendulum a trigger value for the triggering or actuation of the pre-contact switch in normal operation and, for example, a second pendulum a trigger value for the mechanical triggering of the safety brake device in normal operation. A zero pendulum, however, defines a lower trigger value than the first pendulum. The two control cams or the three pendulums are displaceable relative to one another, preferably on a common axle, so that it is possible to change between a normal operating position and an assembly phase position as required. This change between the normal operating position and the assembly phase position is preferably carried out by electromagnets or setting motors, which are preferably remotely controllable and preferably issue a signal coupled with the general safety circuit of the elevator installation.

In the normal operating position the first control cam controls the first pendulum for advance switching-off of the drive during normal operation and the second control cam controls the second pendulum for triggering the safety brake device during normal operation. In the displaced assembly phase position of the pendulum, thereagainst, the first control cam controls the zero pendulum for an upstream switching-off of the drive in the assembly phase and the second control cam controls the first pendulum, which in normal operation ensures advance switching-off of the drive, but now is used for an upstream assembly phase trigger value for the triggering of the safety brake device.

The three different pendulums, whether different due to different masses, different restraining springs or both, are preferably arranged on a common axle and preferably axially adjustable by two stroke magnets or preferably by a setting motor, which sets in two directions, between the normal operating position and the assembly phase position.

Each pendulum is preferably equipped with a further stroke magnet or preferably with a further setting motor in order to better enable switching between the normal operating position and the assembly phase position, preferably at standstill of the elevator installation. For this purpose, particularly in the case of phase-displaced or different control cams, the roller of the pendulums is removed from the surface of the control cam against the restraining force of the restraining spring so that the pendulums can be axially displaced in order to be subsequently lowered back onto the surfaces of the control cams after axial adjustment has been carried out.

Fundamentally, in terms of analogous principle a design variant is also possible in which two pendulums are associated with the three control cams, wherein the control cams preferably preset different trigger values of three stages for preferably identical pendulums. The stages zero and one give the assembly phase trigger values and the stages one and two give the normal operating trigger values.

The significant advantage of the last-described design variant of a speed limiter with two control cams and three pendulums or of one speed limiter with three control cams and two pendulums is not only that a maximum level of safety in the form of an advance switching-off of the drive and triggering of the safety brake device is ensured both in normal operation and in reduced assembly travel, but also that this is realized by a mechanical route independently of possible electrical or electronic failures or possible country-specific legal or technical standards.

All described design variants of speed limiters have revealed cams or lobes of symmetrical construction, i.e. they have, starting from a lowermost point (which usually corresponds with the actual outer diameter of the cam disc) to the crest point of the individual lobe, a rising curve which symmetrically drops away again from the crest point of the individual lobe. However, also within the scope of the disclosure of the present invention are symmetrical designs of lobes which can be optionally used with any of the described design variants of a speed limiter. Through asymmetrical formations of the individual lobes it is possible to achieve, depending on the respective running direction of the limiter cable and thus on the respective rotational direction of the cable pulley or on the respective rotational direction of the cam disc, that one specific trigger value is realized for the downward movement of the elevator car and another for the upward movement of the elevator car.

The described variants of embodiment of lobes or of cam discs or of control cams, which are formed by the lobes, can be combined with one another. In particular, the different designs for definition of two different trigger values can be combined with the phase displacement and with the electrically/electronically defined assembly phase trigger value.

DESCRIPTION OF THE DRAWINGS

The proposed solutions are explained in more detail symbolically and by way of example on the basis of figures. The figures are described conjunctively and generally. The same reference numerals denote identical or the same device parts and reference numerals with different indices indicate functionally equivalent or similar, but separate, device parts even when they are identical with others, but are arranged at a different location or are, in another design variant, a component of another overall function.

DETAILED DESCRIPTION

Figure 1:
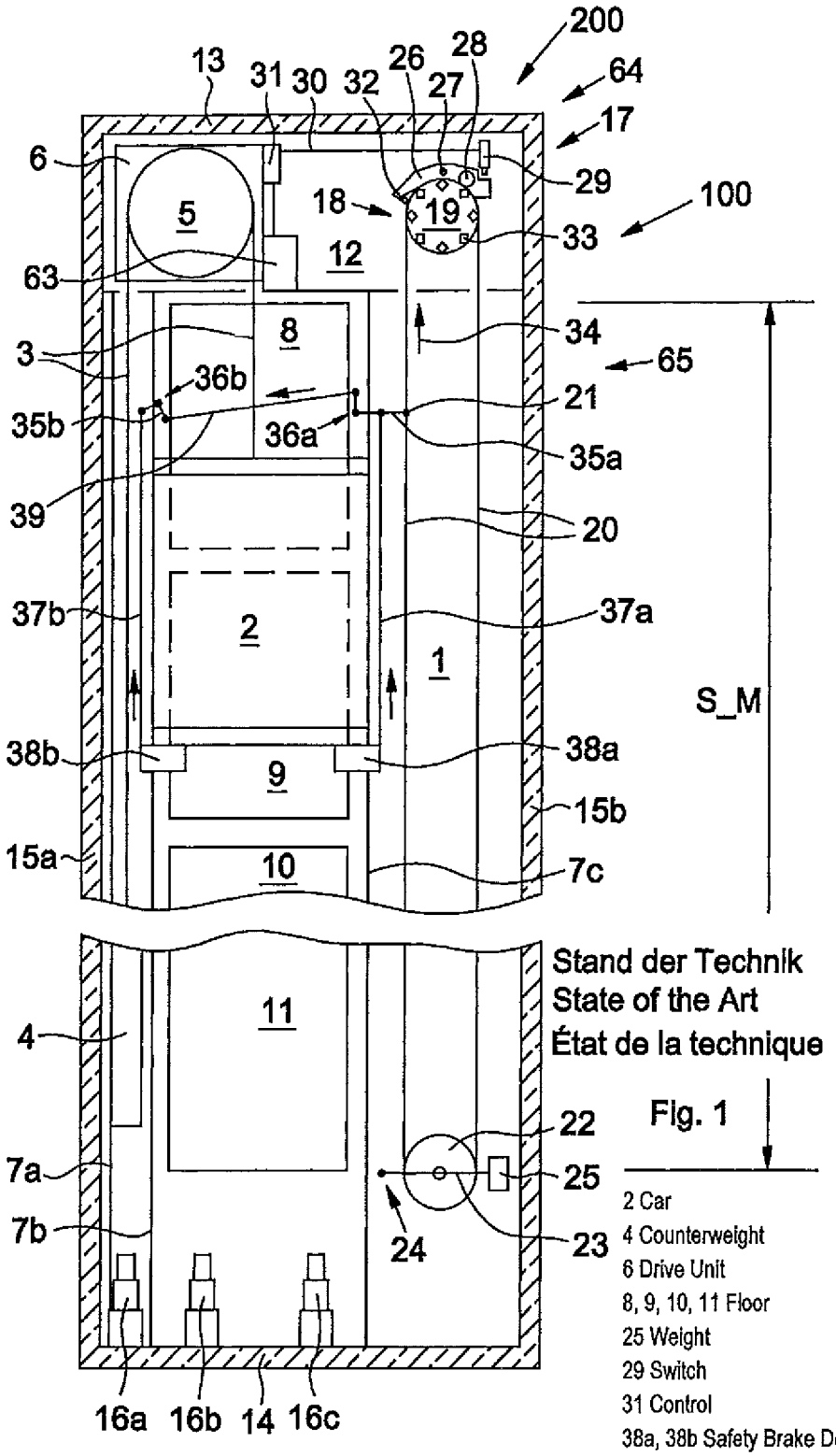
FIG. 1 shows a schematic illustration of an elevator installation with an arrangement of a speed limiter system according to the prior art.

FIG. 1 shows an elevator installation 100 such as is known from the prior art. An elevator car 2 is arranged in the elevator shaft 1 to be movable and is connected by way of a support means 3 with a similarly movable counterweight 4. During operation the support means 3 is driven by a drive pulley 5 of a drive unit 6 arranged in the uppermost region of the elevator shaft 1 in an engine room 12. The elevator car 2 and the counterweight 4 are guided by means of guide rails 7*a* or 7*b* and 7*c* extending over the shaft height.

The elevator car 2 can serve an uppermost floor 8, further floors 9 and 10 and a lowermost floor 11 and thus describe a maximum travel path S_M. The elevator shaft 1 is formed from shaft side walls 15*a* and 15*b*, a shaft ceiling 13 and a shaft base 14, on which a shaft base buffer 16*a* for the counterweight 4 and two shaft base buffers 16*b* and 16*c* for the elevator car 2 are arranged.

The elevator installation 100 further comprises a speed limiter system 200. This in turn comprises a speed limiter 17 with a cable pulley 18, which is fixedly connected with a cam disc 19. The cable pulley 18 and the cam disc 19 are driven by way of a limiter cable 20, since the limiter cable 20 conjunctively describes, due to a fixed connection in the form of a cable coupling 21, the respective upward and downward movements of the elevator car 2. The limiter cable 20 is for this purpose guided as an endless loop over a tensioning roller 22 which is adjustable by a tensioning lever 23 in that the tensioning lever 23 is pivotably mounted in a rotary bearing 24 and a weight 25 is arranged on the tensioning lever 23.

The speed limiter 17 additionally comprises a pendulum 26 which is arranged at an axle 27 to be pivotable in both directions of rotation. Arranged at one side of the pendulum 26 is a roller 28 which is drawn by a restraining spring (not illustrated in more detail in this figure) against the lobes of the cam disc 19.

As first safety step the speed limiter system 200 provides that on reaching a first excess speed VCK the roller 28 can no longer completely run through the valleys between the lobes of the cam disc 19 and thus the pendulum 26 begins to erect in counter-clockwise sense. This erecting movement actuates a pre-contact switch 29 which electrically switches off the drive unit 6 by way of a control line 30 and by way of a control 31. The control 31 is connected with a control device 63 for the entire elevator installation 100, into which all control signals and sensor data flow together.

As a second, purely mechanical safety step the speed limiter system 200 provides that on reaching a second, higher excess speed VCA the pendulum 26 again erects in counter-clockwise sense and thus a pendulum lug 32 engages in recesses in or blocking dogs 33 at the cam disc 19. The cable pulley 18 is thereby blocked and generates, due to the friction between the cable pulley 18 and the limiter cable 20, a tension force 34, by means of which an L-shaped double lever 35*a* is rotated at a pivot point 36*a*. One, approximately horizontal, limb of the L-shaped double lever 35*a* thus actuates a symbolically illustrated safety brake device 38*a* by way of a trigger rod 37*a*. The other, approximately vertical, limb of the double lever 35*a* at the same time exerts a force on a connecting rod 39 and thus rotates a further L-shaped double lever 35*b* about a pivot point 36*b*. As a result, a further trigger rod 37*b* in turn triggers a second safety brake device 38*b*, which is also illustrated only schematically. In this manner a purely mechanical triggering of two mechanically operating safety brake devices 38*a* and 38*b* is realized, which in the case of excess speed or a threatened risk situation fixes the elevator car 2 at the guide rails 7*b* and 7*c*.

The elevator installation 100 thus comprises an upstream advance switching-off of the drive 6 by means of a first mechanism 64 and a downstream actuation of the safety brake devices 38*a* and 38*b* by means of a second mechanism 65.

Figure 2:
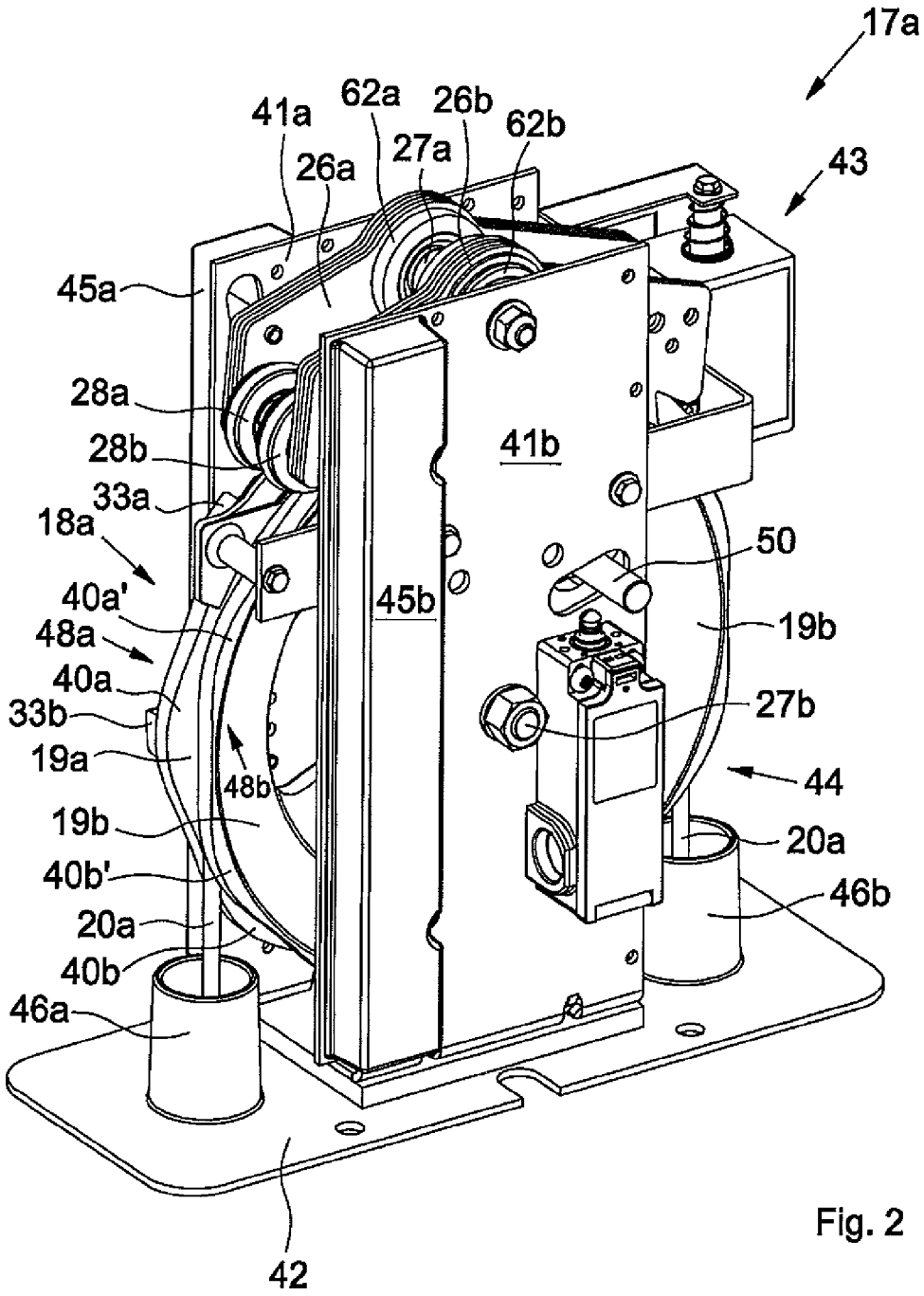
FIG. 2 shows a schematic and perspective illustration of a speed limiter.

FIG. 2 shows in a schematic and perspective detail illustration a variant of embodiment of the speed limiter 17*a*, which stands on an optional bracket 42 with two guide openings 46*a* and 46*b* for a limiter cable 20*a*. The limiter cable 20*a* rotates a cable pulley 18*a*, which is rotatably mounted in two opposite end panels 41*a* and 41*b* on an axle 27*b*.

The cable pulley 18*a* is so shaped that it integrally forms two cam discs 19*a* and 19*b*. These two cam discs 19*a* and 19*b* are displaced in phase, which can be recognized from the fact that lobes 40*a* and 40*b* on the cam disc 19*a* and lobes 40*a*' and 40*b*' corresponding therewith on the cam disc 19*b* are not axially opposite, but offset.

Two blocking dogs 33*a* and 33*b* can be seen on the rear side of the cam disc 19*a*. Moreover, two pendulums 26*a* and 26*b* are pivotably arranged on a common axle 27*a* each in a respective rotary bearing 62*a* or 62*b*. In principle, linear guides are also possible instead of rotary bearings, since the drive by the lobes can also be mechanically directly converted into a linear to-and-fro movement or up-and-down movement of the pendulums. The common axle 27*a* is, like the axle 27*b* for the cable pulley 18*a*, similarly mounted in the end panels 41*a* and 41*b*. The pendulum 26*a* runs by a roller 28*a*, drawn by a restraining spring arranged under a protective cover 45*a*, on a cam track or control cam 48*a* of the cam disc 19*a* and the pendulum 26*b* runs by a roller 28*b* on a cam track or control cam 48*b* of the cam disc 19*b*, wherein this roller 28*b* is also drawn by a restraining spring which is covered by a protective cover 45*b*. The illustrated speed limiter 17*a* further comprises a stroke magnet 43 for remote triggering and a remote resetting switch 44 which actuates a resetting lever 50.

Figure 2A:
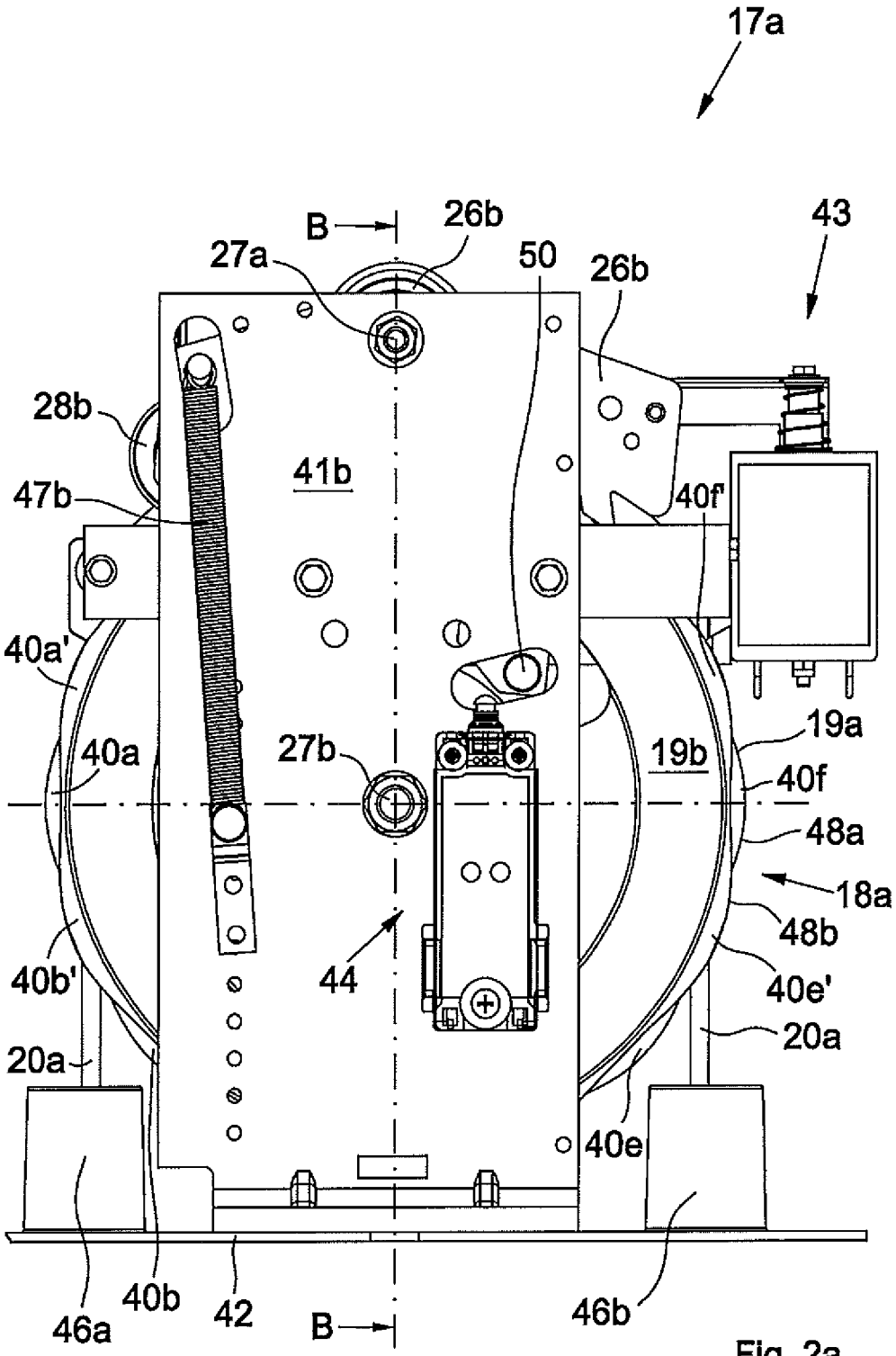
FIG. 2*a* shows a schematic side view of the speed limiter of FIG. 2.

FIG. 2*a* shows the speed limiter 17*a* of FIG. 2 in a schematic side view. Further lobes 40*e*' and 40*f* on the cam disc 19*b* are thereby visible and lobes 40*e* and 40*f* corresponding therewith on the cam disc 19*a*, which in this side view is almost completely covered by the cam disc 19*b*. Moreover, the protective cover 45*b* of FIG. 2 is removed so that a restraining spring 47*b* is visible, which spring draws the roller 28*b* of the pendulum 26*b* against the control cam 48*b* of the cam disc 19*b*.

Figure 2B:
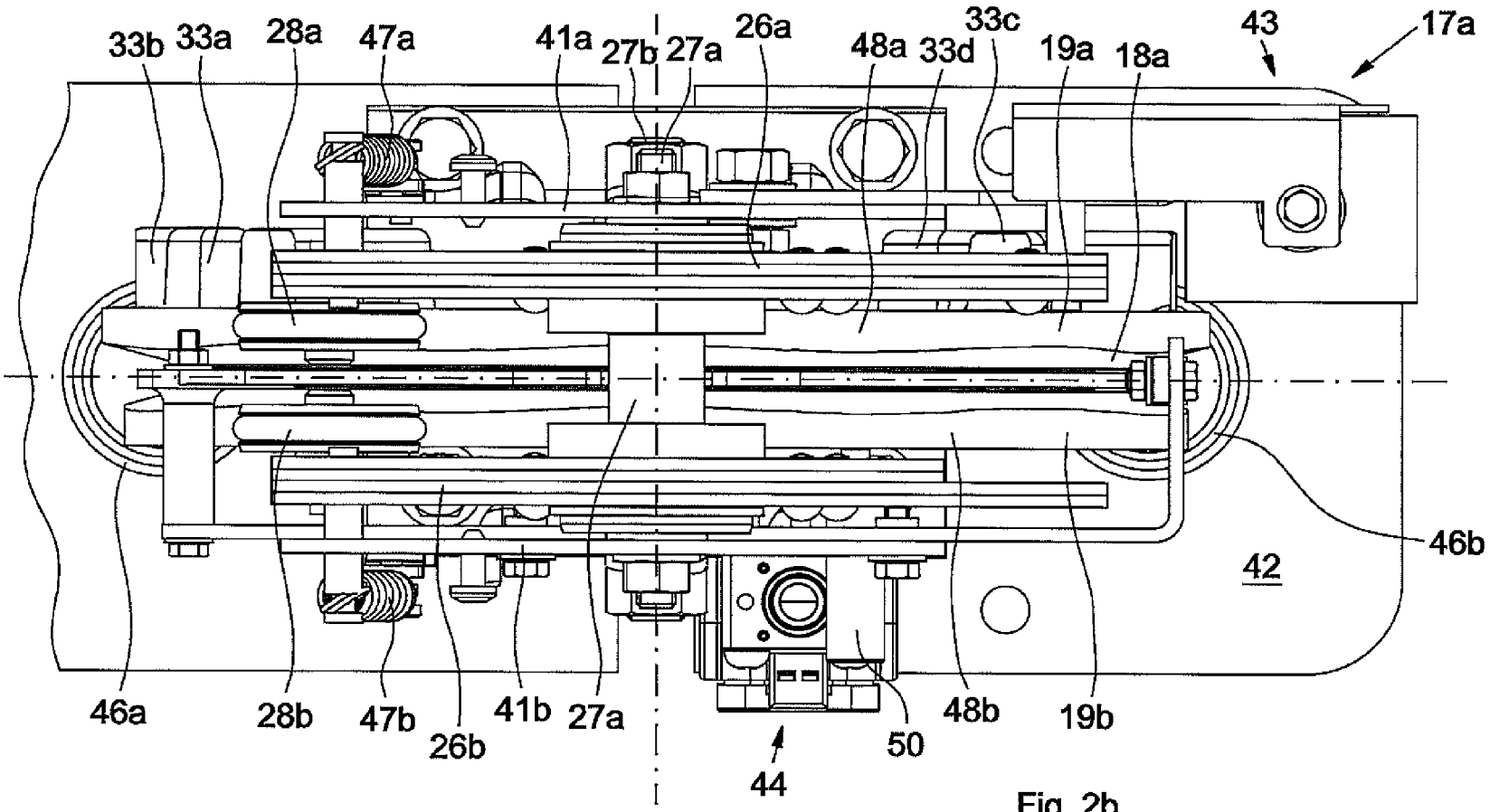
FIG. 2*b* shows a plan view from above of the speed limiter of FIG. 2.

The speed limiter 17*a* of FIG. 2 is shown in FIG. 2*b* in a schematic detail illustration in plan view from above. In this view it can be seen that the cable pulley 18*a* or the cam disc 19*a* has still more blocking dogs 33*c* and 33*d* and that the cam discs 19*a* and 19*b* have not only radial lobes in the form of lobes at the control cams 48*a* and 48*b*, but also axial bulges. These serve for compensation for imbalance. Moreover, the protective covers 45*a* and 45*b* of FIG. 2 are removed so that now a restraining spring 47*a* for the pendulum 26*a* and the restraining spring 47*b* for the pendulum 26*b* can be seen.

Figure 2C:
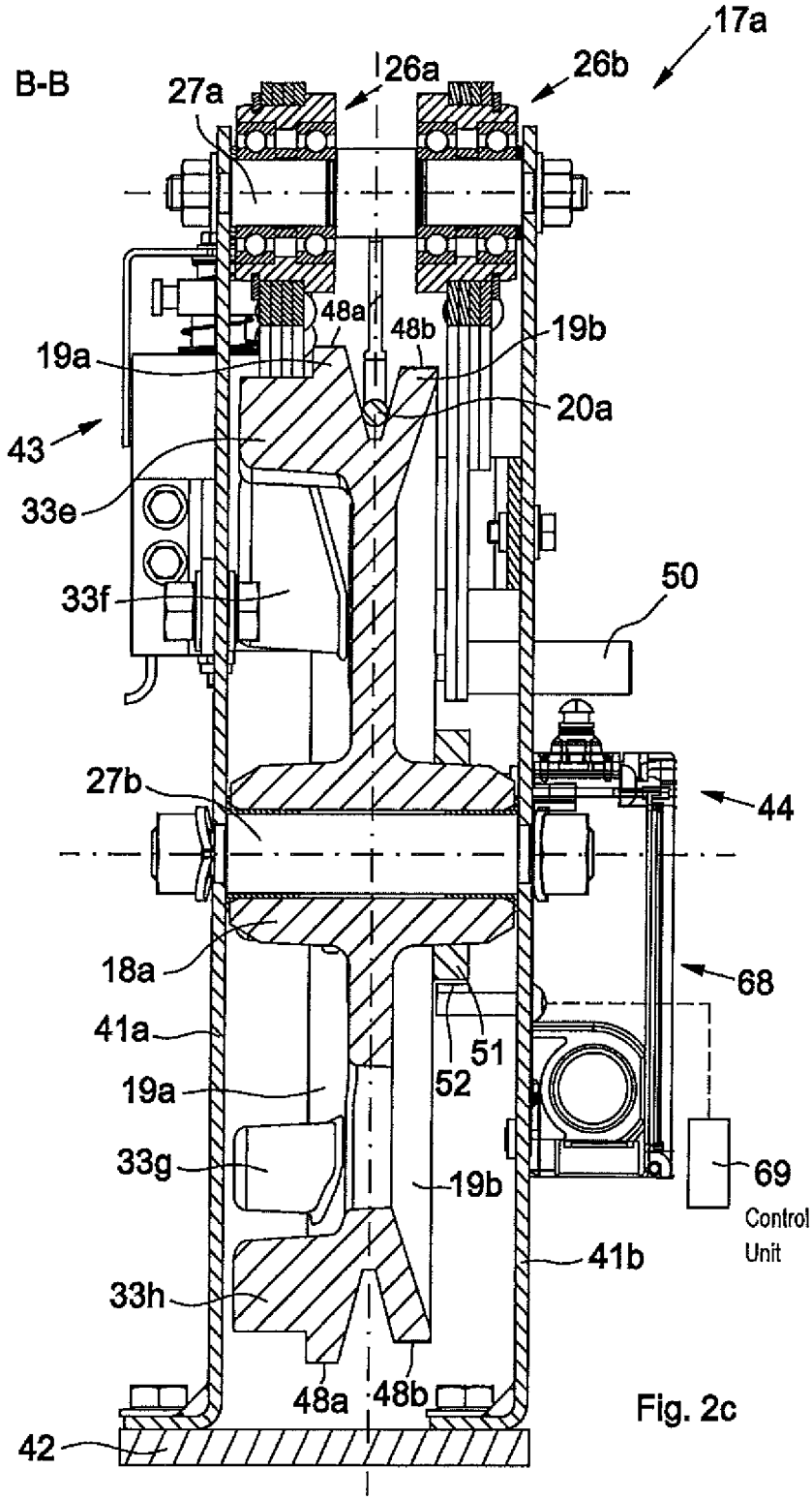
FIG. 2*c* shows a schematic side view of the speed limiter of FIG. 2, sectioned along the section axis B-B of FIG. 2*a;*

FIG. 2*c* shows the speed limiter 17*a* of FIGS. 2, 2*a* and 2*b* in a schematic sectional view B-B, which is produced by an appropriate centrally disposed sectioning axis in FIG. 2*a*. This sectional view B-B shows further blocking dogs 33*e*-33*h* and also that the cable pulley 18*a* is preferably formed integrally and integrates the two cam discs 19*a* and 19*b* with the corresponding control cams 48*a* and 48*b*. Moreover, it is clear from this side view B-B that the blocking dogs 33*e*-33*h* are arranged only at one side of the cable pulley 18*a* or at the cam disc 19*a*.

In this FIG. 2*c* or sectional view B-B an electrical/electronic speed detection is illustrated symbolically in that the rotations of a pole ring 51 are detected by a sensor 52. The pole ring 51 and the sensor 52 form a speed measuring device 68. The signal of the sensor 52 is conducted to a control unit 69, which is connected, preferably bidirectionally, with the central control device 63, which is symbolically illustrated in FIG. 1, for the entire elevator installation 100.

Figure 3:
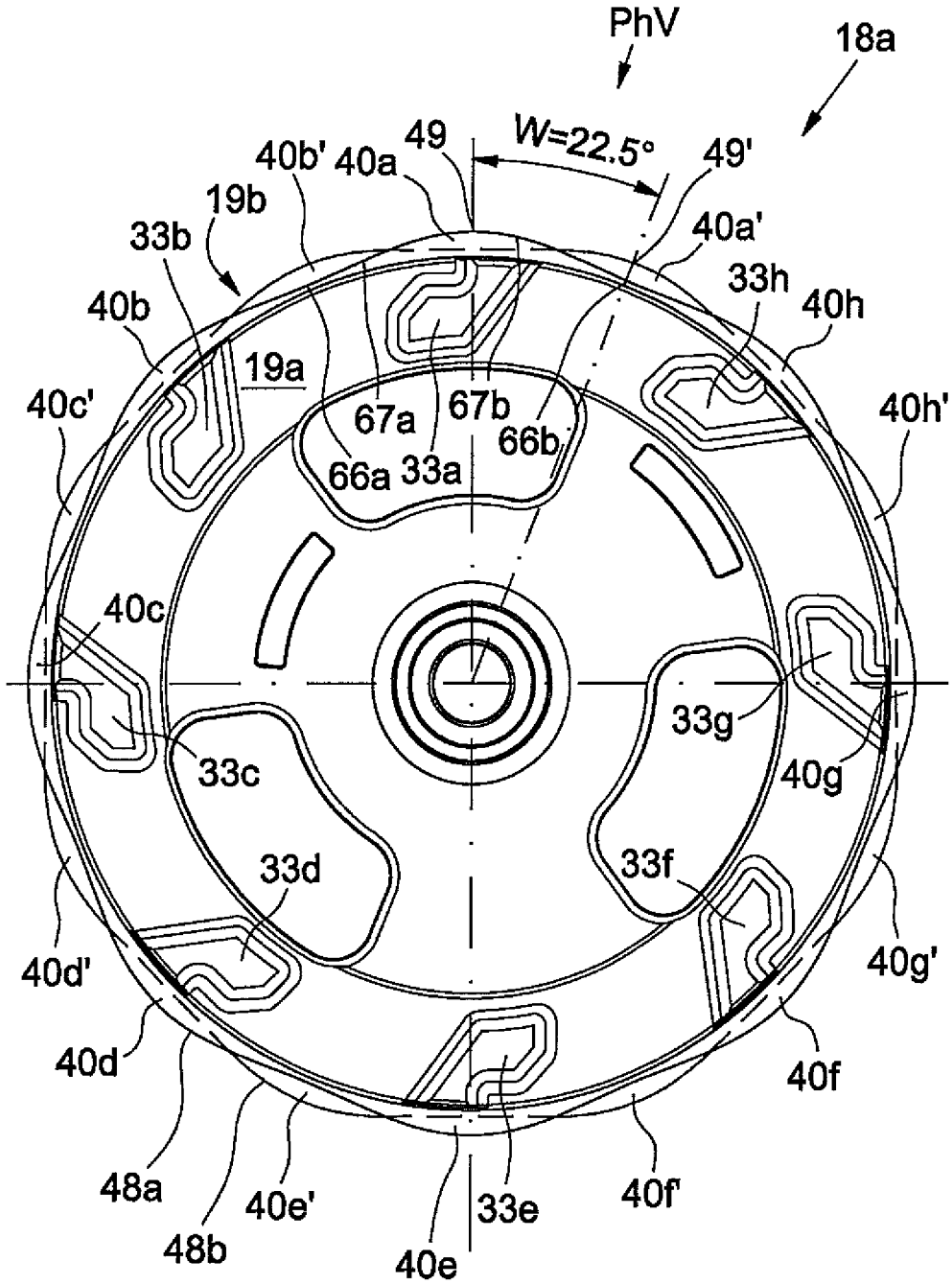
FIG. 3 shows a schematic side view of two cam discs.

Only the cable pulley 18*a*, which at the same time also forms the cam discs 19*a* and 19*b*, is illustrated in FIG. 3. The cam disc 19*a* forms eight blocking dogs 33*a*-33*h* and also eight lobes 40*a*-40*h*, which give the control cam 48*a* of the cam disc 19*a*. The cam disc 19*b* is in this side view covered by the cam disc 19*a* up to a further eight lobes 40*a*'-40*h*', which in turn give the control cam 48*b* of the cam disc 19*b*.

An angle of 22.5 degrees between a crest point 49 of the lobe 40*a* and a further crest point 49' of the lobe 40*a*' signifies that the control cams 48*a* and 48*b* have relative to one another a phase displacement PhV in correspondence with half an angular spacing of two successive lobes of the control cam 48*a* or 48*b*.

The lobe 40*a*, like all other lobes 40*b*-40*h* and 40*a*'-40*h*' as well, defines a first deepest point 66*a*, a first flank 67*a* to a crest point 49 and a second flank 67*b* up to a second deepest point 66*b*. The first flank 67*a* and the second flank 67*b* are symmetrically illustrated in the present FIG. 3, but, as already mentioned, the flanks 67*a* and 67*b* can also be formed asymmetrically in order to impart different mass pulses to the pendulums depending on the respective rotational direction of the cable pulley 18*a* or speed limiter wheel.

Figure 3A:
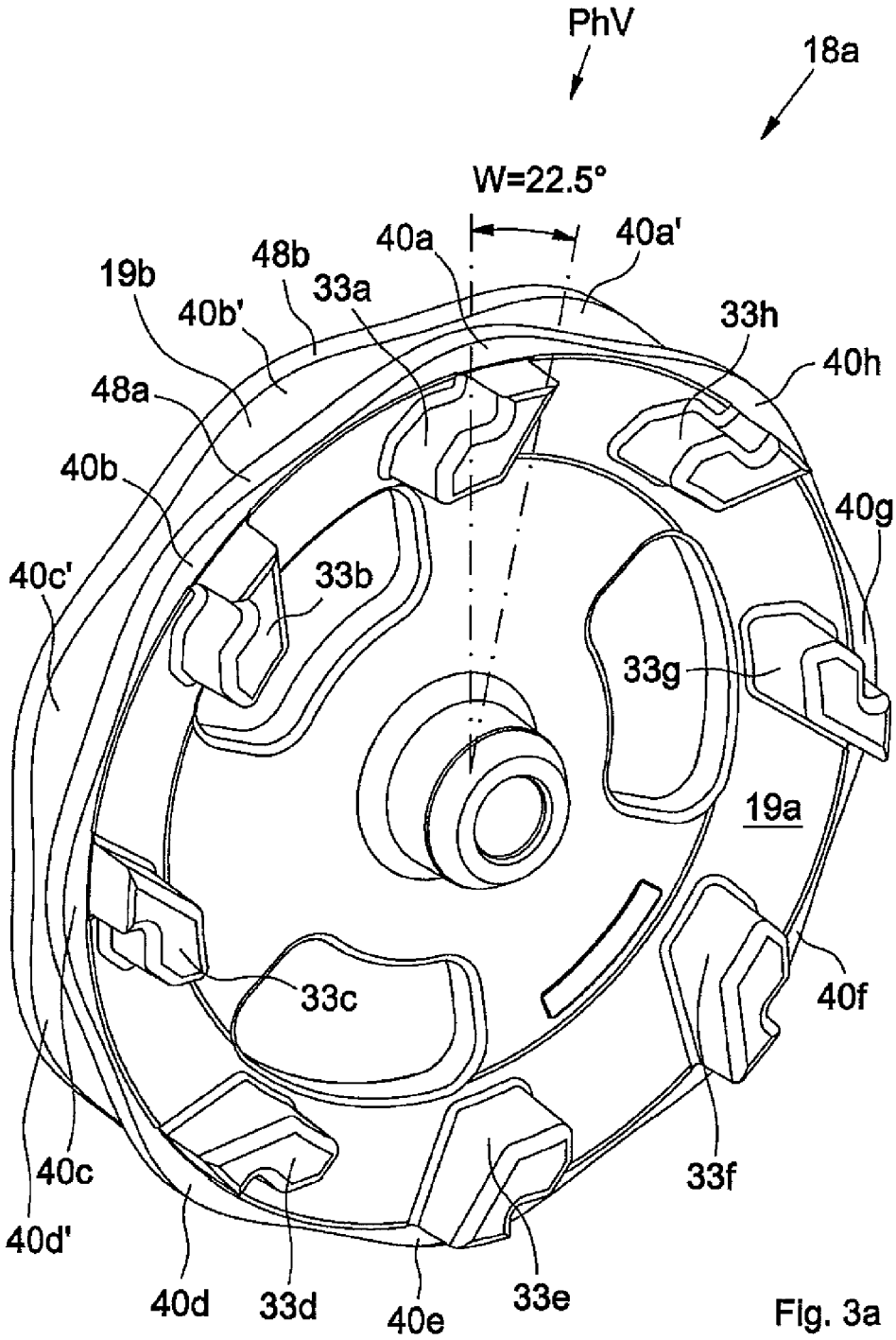
FIG. 3*a* shows a perspective illustration of the cam discs of FIG. 3.

In FIG. 3*a* the cable pulley 18*a* with the cam discs 19*a* and 19*b* of FIG. 3 is illustrated perspectively so that the shape thereof and also the shape of the blocking dogs 33*a*-33*h* can be better seen.

Figure 4A:
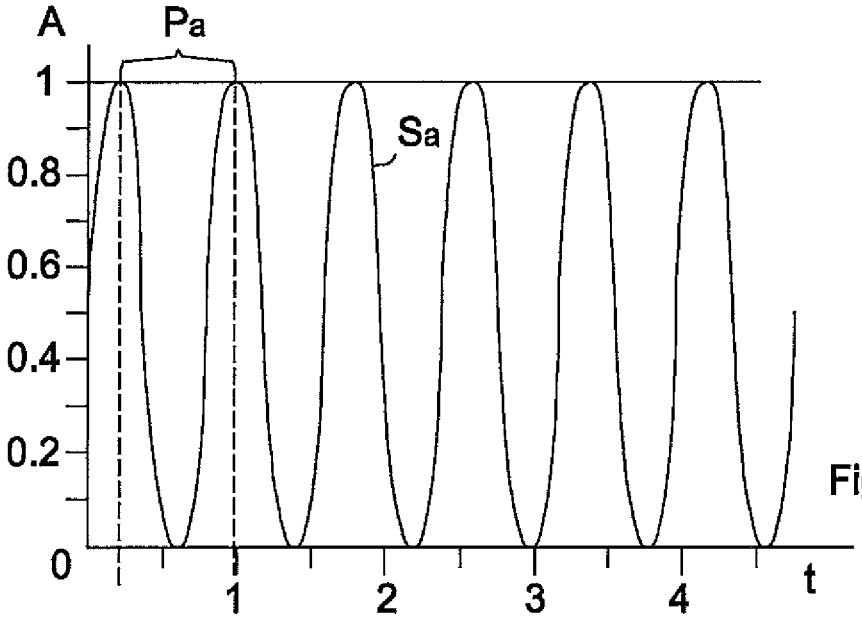
FIG. 4*a* shows a schematic diagram of the control cams in two cam discs of the same phase.

FIG. 4*a* shows, in a diagram, a sinusoidal oscillation plot $S_a$ which, for example, the cam disc 19*a* or the control cam 48*a* produces at the pendulum 26*a*. Illustrated on the X axis is a time t and on the Y axis an amplitude A. The oscillation plot $S_a$ has a period $P_a$.

Figure 4B:
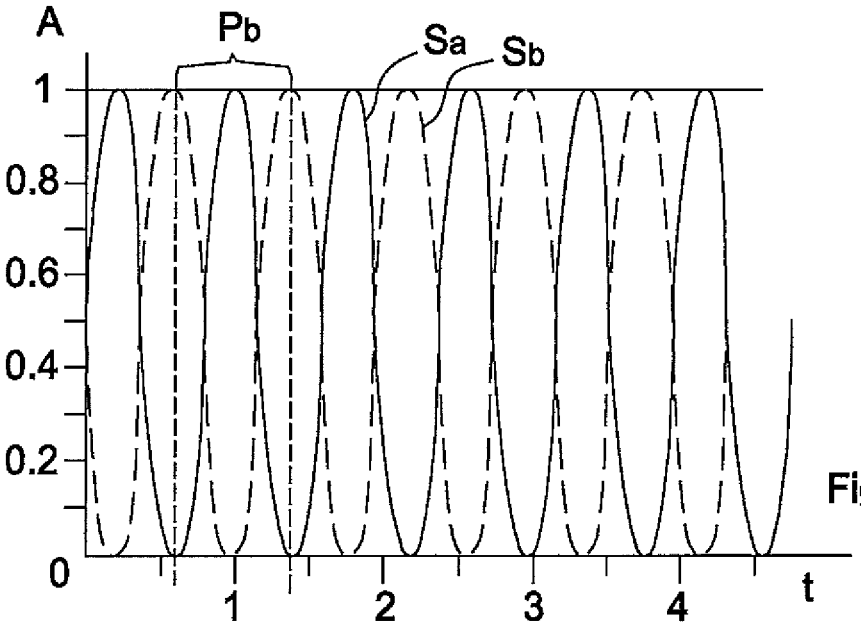
FIG. 4*b* shows a schematic diagram of two phase-displaced control cams.

FIG. 4*b* shows, additionally to the oscillation plot $S_a$ of FIG. 4*a*—illustrated by dashed lines—an identical, but phase-displaced oscillation plot $S_b$ of the pendulum 26*b* produced by the other cam disc 19*b* or the other control cam 48*b*. The oscillation plot $S_b$ has a period $P_b$ identical with the period $P_a$ of the oscillation plot $S_a$.

Figure 4C:
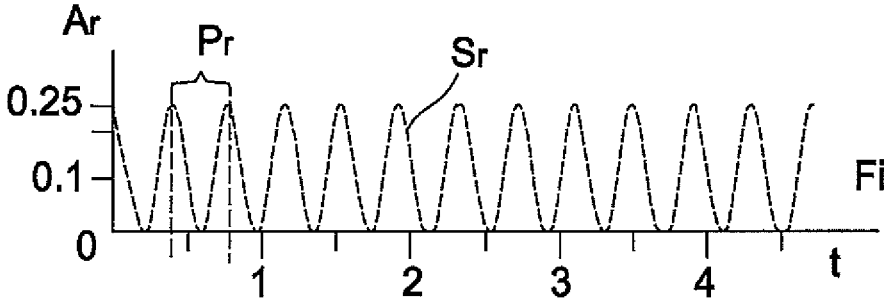
FIG. 4*c* shows a schematic diagram of the resulting superimposition of the control cams of FIG. 4*b;*

An oscillation plot $S_r$ resulting from the oscillation plot $S_a$ and the oscillation plot $S_b$ is illustrated in FIG. 4*c*. The oscillations of the pendulums 26*a* and 26*b* for the major part are mutually cancelling so that a resultant amplitude $A_r$ is only a fourth of the former amplitude A. A period $P_r$ of the resultant oscillation plot $S_r$ is only half as large as the periods $P_a$ and $P_b$, i.e. the frequency of the oscillations of the pendulums 26*a* and 26*b* is twice as fast, but four times weaker.

Figure 5:
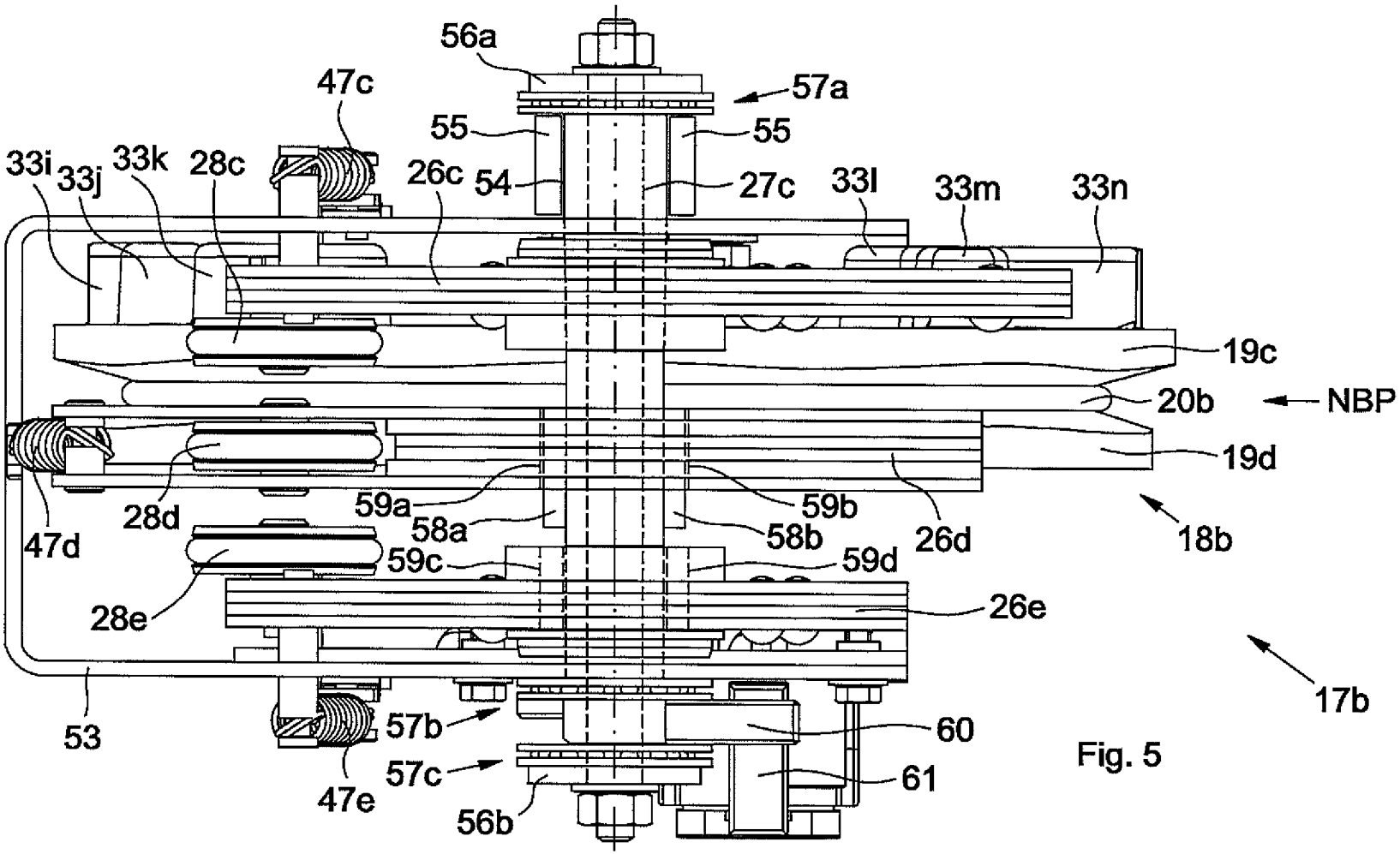
FIG. 5 shows a schematic plan view from above of a further variant of embodiment of a speed limiter with three pendulums and two different cam discs, wherein the cam disc pair stands at a normal operating position.

FIG. 5 schematically shows a further variant of embodiment of a speed limiter 17*b* in a plan view from above. This speed limiter 17*b* similarly comprises a cable pulley 18*b* which defines two cam discs 19*c* and 19*d*. A limiter cable 20*b* runs between the cam discs 19*c* and 19*d*, which are preferably displaced in phase. By contrast to the variant of embodiment of a speed limiter 17*a* previously illustrated in FIGS. 2 to 4 in this variant of embodiment of a speed limiter 17*b* the cam discs 19*c* and 19*d* are arranged to be axially displaceable in that—after removal of a pawl 55—switching levers 56*a* and 56*b* are axially displaceable on an axle 27*c* together with an axle sleeve 54.

Moreover, this variant of embodiment of a speed limiter 17*b* comprises not only two, but three pendulums 26*c*-26*e*. These three pendulums 26*c*-26*e* have different trigger values in that the pendulum 26*c* has more mass than the pendulum 26*d* and this latter pendulum 26*d* in turn has more mass than the pendulum 26*e*. This step-shaped spread of the three trigger values of the three pendulums 26*c*-26*e* can additionally—or also exclusively in the case of identically formed pendulums 26*c*-26*e*—be achieved by means of restraining springs 47*c*-47*e* of different strengths, which are arranged at a frame 53 for the pendulums 26*c*-26*e*, respectively.

The illustrated position of the cam discs 19*c* and 19*d* corresponds with a normal operating position NBP in which a roller 28*c* of the pendulum 26*c* runs on the cam disc 19*c* and a roller 28*d* of the pendulum 26*d* runs on the cam disc 19*d*. The earlier trigger value of the pendulum 26*d* causes, in the case of a specific excess speed, a pendulating movement in the sense of a centrally oscillating to-and-fro movement of a latch 60 arranged at the axle sleeve 54, which movement becomes of such magnitude that the latch 60 actuates a pre-contact switch 61. In other words, the oscillatory pendulating movement of the pendulum 26*d* is transmitted to the latch 60 in that the axle sleeve 54 forms two springs 58*a* and 58*b* which are each received, in shape-coupling manner, in a respective groove 59*a* or 59*b* in the pendulum 26*d*.

The pendulum 26*e* with a corresponding roller 28*e* is without function in the illustrated normal operating position NBP, i.e. it is stationary, because on the one hand it does not have a driving cam disc under the roller 28*e* and because on the other hand it is mounted, preferably by a low-friction needle bearing, to be rotatable about the axle sleeve 54. The pendulum 26*e* has grooves 59*c* and 59*d* which correspond with the springs 58*a* and 58*b*, but which are free so that the pendulum 26*e* can yield to the force of the restraining spring 47*e*, preferably against an abutment (not illustrated in more detail).

If the excess speed further rises, the control cam of the cam disc 19*c* excites the pendulum 26*c* so strongly that a pendulum nose (also not illustrated in more detail) latches into one of the blocking dogs 33*i*-33*n*. The illustrated normal operating position NBP of the speed limiter 17*b* thus has a purely mechanical triggering which can be used for triggering of the safety brake devices. Moreover, it has an upstream triggering which can be used for mechanical actuation of a pre-contact switch and thus for advance switching-off of the drive.

The pendulums 26*c*-26*e*, the axle 27*c* and the axle sleeve 54 are preferably mounted in low-friction needle bearings, in which the needles are held or encapsulated. The axle sleeve 54 is preferably mounted by axial ball bearings 57*a*-57*c* on the fixedly disposed switch levers 56*a* and 56*b* or on the frame 53.

The switch levers 56*a* and 56*b* in the illustrated form displace not only the axle 27*c*, but also the axle sleeve 54. However, an embodiment is also possible in which the axle is stationary and the switch levers 56*a* and 56*b* displace only the axle sleeve 54 on the axle 27*c*.

Figure 5A:
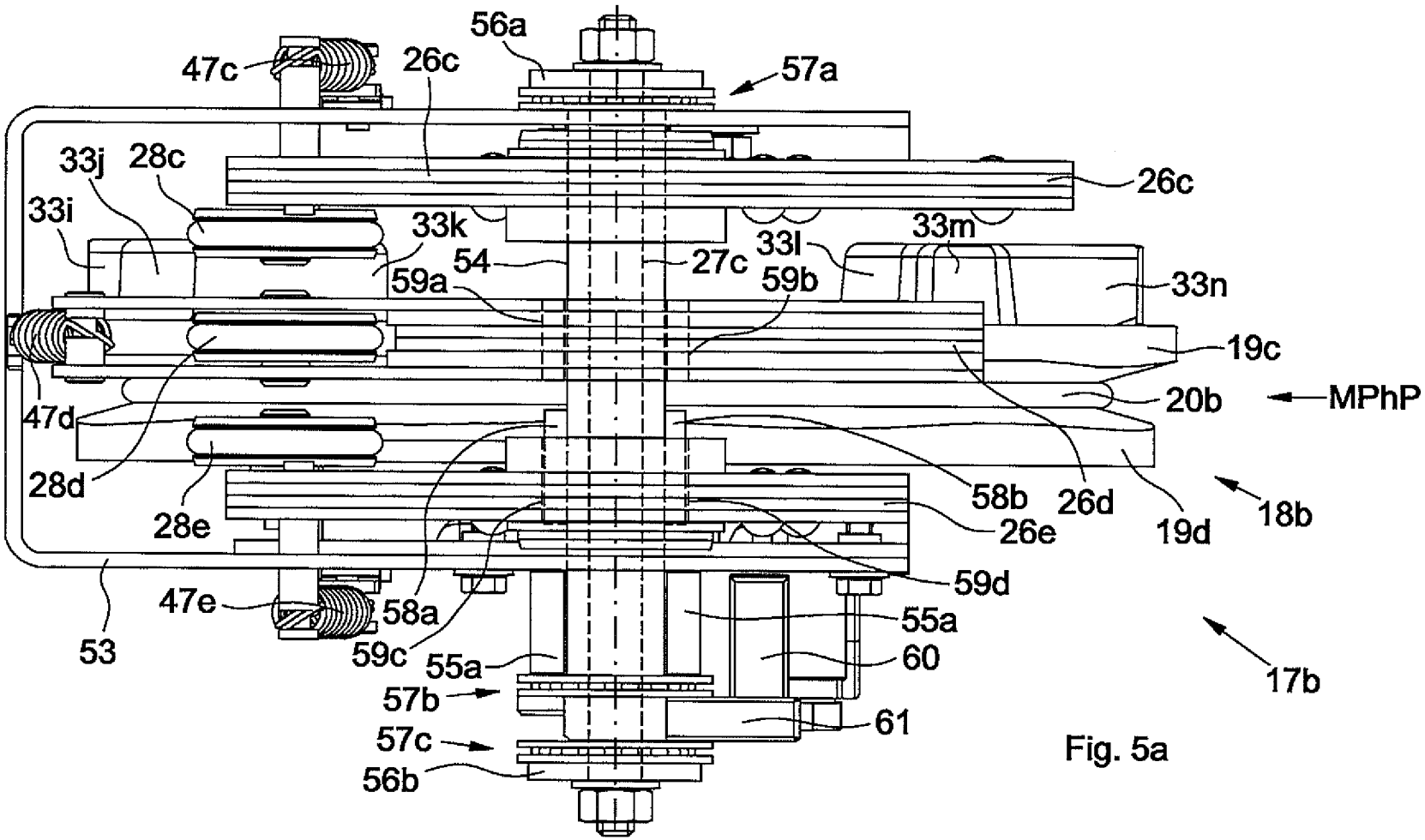
FIG. 5*a* shows a schematic plan view from above of the variant of embodiment of the speed limiter of FIG. 5, wherein the cam disc pair is displaced into an assembly phase operating position.

FIG. 5*a* shows the variant of embodiment of a speed limiter 17*b* in an assembly phase position MPhP. Coupled with a displacing movement of the switch levers 56*a* and 56*b* the cable pulley 18*b* has been displaced preferably after stroke magnets or electrical setting motors (not illustrated in more detail) have lifted the pendulums 26*c*-26*e* or the rollers 28*c*-28*e* against the force of their respective restraining springs 47*c*-47*e*.

In the illustrated assembly phase position MPhP the pendulum 26*c* is now out of operation and the pendulum 26*e* is in use, because the springs 58*a* and 58*b* are now received, with mechanically positive couple, in the grooves 59*c* and 59*d* of the pendulum 26*e*. The lightest pendulum 26*e* thus delivers a trigger value which is again upstream of the upstream trigger value in the normal operating position NBP—without any electronic adjustment being needed—and can be used for switching-off the drive.

The pendulum 26*d* now supplies—in correspondence with the access speed value which in the normal operating position NBP would have caused upstream triggering for actuation of the pre-contact switch—a triggering, which as before is purely mechanical, but which is upstream, for actuation of the safety brake devices. This triggering is thus matched to the reduced rated operating speed of the elevator installation in the assembly phase.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A speed limiter for an elevator installation, comprising:

a speed limiter wheel with a first cam disc having a first control cam with lobes and with a second cam disc having a second control cam with lobes;

a first mass which rolls by a first roller on the first control cam so that the first mass describes a first oscillatory motion during rotations of the speed limiter wheel;

a second mass which rolls by a second roller on the second control cam so that the second mass describes a second oscillatory motion during rotations of the speed limiter wheel, wherein there is a phase displacement between the first control cam and the second control cam for reducing vibration in the speed limiter; and wherein the first mass on reaching a first excess speed actuates a first mechanism for advance switching-off of a drive of the elevator installation and on reaching a second, higher excess speed the second mass triggers a second mechanism for actuation of at least one safety brake device for an elevator car of the elevator installation.

2. The speed limiter according to claim 1 wherein the first mechanism includes a remote reset switch and a stroke magnet and the second mechanism can be remotely triggered by another stroke magnet.

3. The speed limiter according to claim 2 wherein the second mechanism is activatable by a signal of a speed measuring device of the elevator installation.

4. The speed limiter according to claim 3 wherein the speed measuring device includes at least one magnetic pole ring and at least one inductive sensor.

5. The speed limiter according to claim 3 wherein the speed measuring device is in communication with a control unit into which a reduced car rated speed of the elevator installation can be input.

6. The speed limiter according to claim 1 wherein the first cam disc and the second cam disc are arranged to be displaceable to enable selective switching between a normal operating position and a mounting phase position wherein in the normal operating position there is actuation of the first mechanism by the first mass and triggering of the second mechanism by the second mass, and in the mounting phase position there is actuation of the first mechanism by a third mass and triggering of the second mechanism by the first mass.

7. The speed limiter according to claim 1 wherein the first cam disc and the second cam disc are arranged to be displaceable to enable selective switching between a normal operating position and a mounting phase position wherein in the normal operating position the first mass and the second mass are controlled by the first cam disc and the second cam disc respectively, and in the mounting phase position a third mass and the first mass are controlled by the first cam disc and the second cam disc respectively.

8. A speed limiter for an elevator installation, comprising:

a speed limiter wheel with a first cam disc having a first control cam with lobes and with a second cam disc having a second control cam with lobes;

a first mass which rolls by a first roller on the first control cam so that the first mass describes a first oscillatory motion during rotations of the speed limiter wheel; and a second mass which rolls by a second roller on the second control cam so that the second mass describes a second oscillatory motion during rotations of the speed limiter wheel, wherein there is a phase displacement between the first control cam and the second control cam for reducing vibration in the speed limiter.

9. The speed limiter according to claim 8 wherein the first oscillatory motion of the first mass and the second oscillatory motion of the second mass are in an opposite sense so that an upward movement of one of the first and second masses corresponds with a downward movement of another of the first and second masses.

10. The speed limiter according to claim 8 wherein the first oscillatory motion of the first mass and the second oscillatory motion of the second mass are symmetrically asynchronous so that a highest point of the first oscillatory motion of the first mass respectively corresponds with a lowest point of the second oscillatory motion of the second mass.

11. The speed limiter according to claim 8 wherein the first control cam and the second cam each have eight of the lobes which are displaced in phase in a range of 15 to 30 degrees, but preferably by 22.5 degrees.

12. The speed limiter according to claim 8 wherein the first control cam and the second cam each have eight of the lobes which are displaced in phase by 22.5 degrees.

13. The speed limiter according to claim 8 wherein a moment of inertia of the first mass differs from a moment of inertia of the second mass.

14. The speed limiter according to claim 8 wherein the first mass is arranged at an axle in a first rotary bearing to be rotatable and the second mass is arranged at the axle in a second rotary bearing to be rotatable.

15. The speed limiter according to claim 8 wherein the speed limiter wheel is a cable pulley at which the first and second cam discs are fixedly arranged.

16. A method of operating a speed limiter, comprising the following steps:

providing a speed limiter wheel with a first mass with a first roller, a first cam disc with a first control cam, a second mass with a second roller, and a second cam disc with a second control cam;

rolling the first roller of the first mass on the first control cam of the first cam disc so that the first mass is set into a first oscillatory motion; and rolling the second roller of the second mass on the second control cam of the second cam disc so that the second mass is set into a second oscillatory motion, wherein the first control cam and the second control cam are displaced in phase relative to one another or arranged with a phase displacement to reduce vibrations in the speed limiter.

* * * * *